United States Patent [19]

Ishihara et al.

[11] 4,303,799

[45] Dec. 1, 1981

[54] INSULATOR COMPRISING A HOLDING METAL FITTING AND A FIBER REINFORCED PLASTIC ROD HELD IN THE SLEEVE OF THE METAL FITTING UNDER PRESSURE

[75] Inventors: Takeshi Ishihara, Toyoake; Masaru Kojima, Nagoya, both of Japan

[73] Assignee: NGK Insulators Ltd., Nagaya, Japan

[21] Appl. No.: 112,324

[22] Filed: Jan. 15, 1980

[30] Foreign Application Priority Data

Jan. 20, 1979 [JP] Japan ..... 54-5450

[51] Int. Cl.[3] ..... H01B 17/02; H01B 17/40

[52] U.S. Cl. ..... 174/176; 403/284; 403/285

[58] Field of Search ..... 174/79, 84 C, 140 S, 174/176, 177, 178, 179, 186; 29/517; 403/274, 278, 281, 284, 285, 300, 305, 404

[56] References Cited

U.S. PATENT DOCUMENTS

| | | | |
|---|---|---|---|
| 1,959,402 | 5/1934 | Anderson | 403/284 |
| 2,668,280 | 2/1954 | Dupre | 174/179 X |
| 3,152,392 | 10/1964 | Coppack et al. | 174/177 X |
| 3,192,622 | 7/1965 | Bannerman | 174/177 X |
| 3,994,607 | 11/1976 | Kikuchi et al. | 403/284 |

FOREIGN PATENT DOCUMENTS

| | | | |
|---|---|---|---|
| 1957460 | 5/1971 | Fed. Rep. of Germany | 174/179 |

*Primary Examiner*—Laramie E. Askin

*Attorney, Agent, or Firm*—Stevens, Davis, Miller & Mosher

[57] ABSTRACT

An insulator having an improved fatigue life is disclosed. The insulator comprises a fiber reinforced plastic rod and a holding metal fitting composed wholly or partly of a sleeve, which has a base portion and an inlet portion having a tapered thickness, and holds the rod in the sleeve under pressure.

4 Claims, 14 Drawing Figures

INSULATOR COMPRISING A HOLDING METAL FITTING AND A FIBER REINFORCED PLASTIC ROD HELD IN THE SLEEVE OF THE METAL FITTING UNDER PRESSURE

BACKGROUND OF THE INVENTION (1) Field of the Invention

The present invention relates to an insulator comprising a rod or pipe made of fiber reinforced plastic (hereinafter referred to as a reinforced plastic rod) and a holding metal fitting to which the rod is secured, and particularly to the improvement of the fatigue life of such an insulator.

(2) Description of the Prior Art

Structures for holding a reinforced plastic rod by a holding metal fitting in an insulator are disclosed, for example, in U.S. Pat. Nos. 3,152,392 and 3,192,622. In the holding structure disclosed in U.S. Pat. No. 3,152,392, a portion of a reinforced plastic rod to be held is inserted into the bore of a sleeve of a holding metal fitting, and the outer circumference of the sleeve is compressed from opposite directions by means of a two-piece polygonal die such that the cross-section of the sleeve is permanently deformed into a polygonal shape to secure the reinforced plastic rod to the holding metal fitting. In the holding structure disclosed in U.S. Pat. No. 3,192,622, a reinforced plastic rod is secured to a holding metal fitting in the following manners. That is, the rod is inserted into the bore of a sleeve having a uniform thickness, and the sleeve is compressed and deformed by means of a tapered polygonal die such that the outer diameter of the sleeve is not substantially reduced at the reinforced plastic rod-receiving tip of the sleeve but is reduced in a large amount at a portion opposed to the rod end; or a reinforced plastic rod is inserted into the bore of a sleeve having a tapered thickness, and the sleeve is compressed and deformed such that the outer diameter of the sleeve is not substantially reduced at the rod-receiving tip of the sleeve but is reduced in a large amount at a portion opposed to the rod end and by means of a polygonal die having opposite planes arranged in parallel. However, these conventional holding structures merely aim to improve the static load performance, and stress concentration occurs in the reinforced plastic rod at the portion opposed to the vicinity of the reinforced plastic rod-receiving tip of the sleeve, and hence the rod is broken at a lower cyclic load.

SUMMARY OF THE INVENTION

The object of the present invention is to provide an insulator, which is free from the above-described drawbacks and has an improved fatigue life.

The feature of the present invention is the provision of an insulator comprising a fiber reinforced plastic rod and a holding metal fitting wholly or partly composed of a sleeve and holding said rod in the sleeve under pressure, an improvement comprising constituting said sleeve with a base portion for defining mainly the static load performance of the insulator, and an inlet portion having a tapered thickness and defining mainly the vibration fatigue performance of the insulator.

DETAILED DESCRIPTION OF THE INVENTION

Figure 1A:
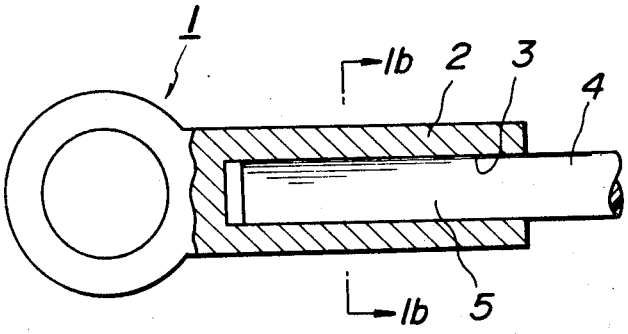
PRIOR ART FIG. 1a
FIG. 1*a* is a front view of a conventional insulator partly in section, showing that portion of a reinforced plastic rod which is held in a sleeve of a holding metal fitting, before the sleeve is compressed.
Figure 1B:
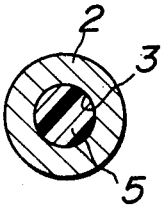
PRIOR ART FIG. 1b
FIG. 1*b* is a cross-sectional view of the insulator shown in FIG. 1*a* taken on the line 1*b*—1*b* in the arrow direction.
Figure 2A:
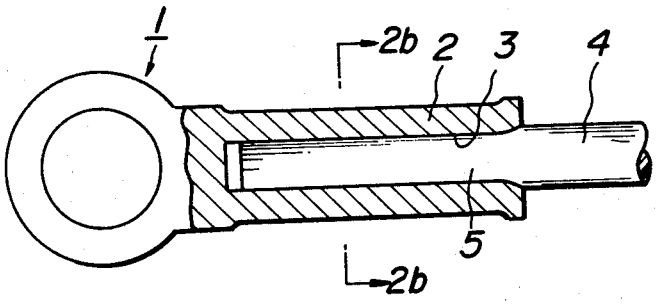
PRIOR ART FIG. 2a
FIG. 2*a* is a front view of the insulator shown in FIG. 1*a* partly in section, showing that portion which is held in a sleeve of a holding metal fitting, after the sleeve is compressed.
Figure 2B:
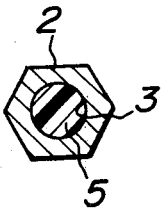
PRIOR ART FIG. 2b
FIG. 2*b* is a cross-sectional view of the insulator shown in FIG. 2*a* taken on the line 2*b*—2*b* in the arrow direction.
Figure 3A:
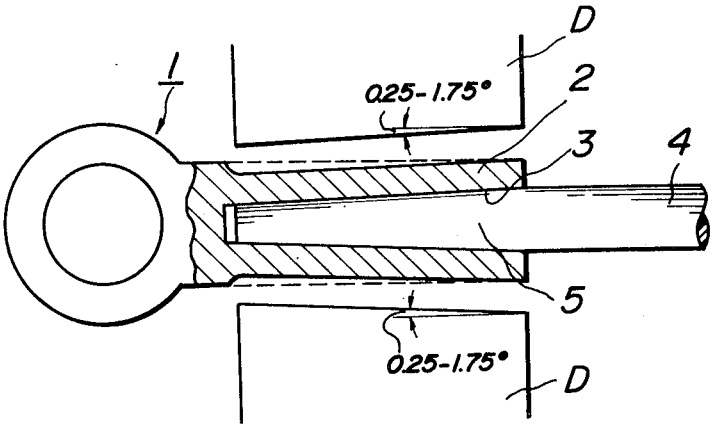
PRIOR ART FIG. 3a
FIGS. 3*a* and 3*b* are cross-sectional views of other conventional insulators partly in section, showing that portion of a reinforced plastic rod which is held in a sleeve of a holding metal fitting.
Figure 3B:
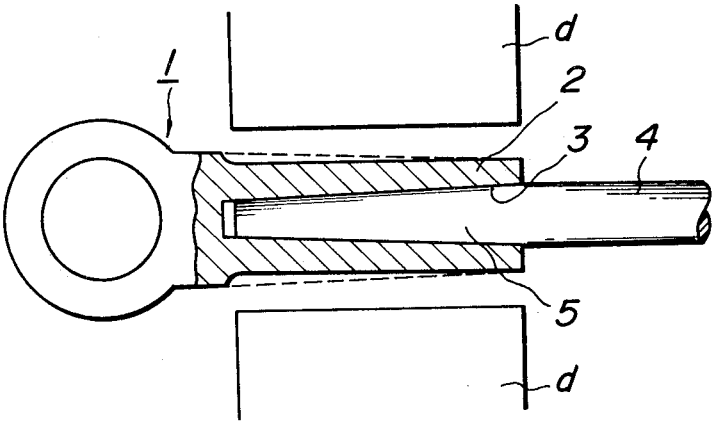
PRIOR ART FIG. 3b

For an easy understanding of the structure for holding a reinforced plastic rod by a holding metal fitting in the insulator according to the present invention, an explanation will be made with respect to the holding structure disclosed in the above-described U.S. Pat. Nos. 3,152,392 and 3,192,622. In the holding structure disclosed in U.S. Pat. No. 3,152,392, as illustrated in FIGS. 1*a* and 1*b*, a portion 5 of a reinforced plastic rod to be held is inserted into the bore 3 of a sleeve 2, which constitutes whole or a part of a holding metal fitting 1, and the outer circumference of the sleeve 2 is compressed from opposite directions, for example, by means of a two-piece polygonal die such that the cross-section of the compressed sleeve 2 is permanently deformed into a polygonal shape, such as hexagonal shape shown in FIGS. 2*a* and 2*b*, to secure the reinforced plastic rod 4 to the holding metal fitting 1. This holding structure is useful, because the structure is high in the static tensile strength, is simple in the shape of the portion of a reinforced plastic rod to be held, in the structure of a holding metal fitting and in the apparatus to be used for securing the rod to the holding metal fitting, and is small in the weight of the holding metal fitting. Further, U.S. Pat. No. 3,192,622 discloses holding structures illustrated in FIGS. 3*a* and 3*b* in order to obtain an improved static tensile strength. In the holding structure illustrated in FIG. 3*a*, a reinforced plastic rod 4 is inserted into a sleeve 2 having a uniform thickness, and the sleeve is compressed and deformed such that the outer diameter of the sleeve is not substantially reduced at the reinforced plastic rod-receiving tip of the sleeve but is reduced in a large amount at a portion opposed to the rod end by means of a tapered polygonal die D having opposite planes inclined, for example, at an angle of 0.25°–1.75° with respect to the insulator axis. In the holding structure illustrated in FIG. 3*b*, a reinforced plastic rod 4 is inserted into a sleeve 2 having a tapered thickness, which increases from the reinforced plastic rod-receiving tip towards the rod end, and the sleeve 2 is compressed and deformed such that the outer diameter of the sleeve is not substantially reduced at the reinforced plastic rod-receiving tip of the sleeve but is reduced in a large amount at a portion opposed to the rod end by means of a polygonal die d having opposite planes arranged in parallel. However, these conventional holding structures merely aim to improve the static load performance.

That is, the breakage of insulators having a conventional holding structure due to the static tensile load is caused by the stress concentration in a reinforced plastic rod 4 at the portion opposed to the vicinity of the reinforced plastic rod-receiving tip of the sleeve 2. When the maximum tensile stress $\sigma_1$ is larger than the strength $\sigma_M$ of the reinforced plastic rod 4, the rod is broken. For example, when a tensile force P (static load) is applied between a reinforced plastic rod 4 and a sleeve 2 as shown in FIG. 4*b*, a tensile stress $\sigma_{FRP}$ caused in the rod 4 is remarkably lower than the strength $\sigma_M$ of the rod 4 as shown by the characteristic curve a in FIG. 4*a*, but a stress $\sigma_1$ concentrated in the rod 4 at the vicinity of the reinforced plastic rod-receiving tip of a sleeve is remarkably larger than the stress $\sigma_{FRP}$ as shown in FIG. 4*a*.

Figure 4A:
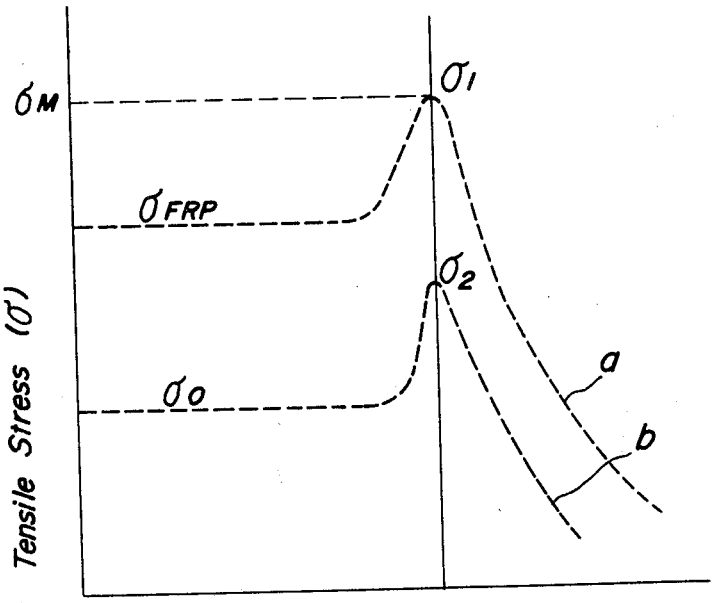
PRIOR ART FIG. 4a
FIG. 4*a* is a stress distribution curve in a reinforced plastic rod held by a conventional holding structure.
Figure 4B:
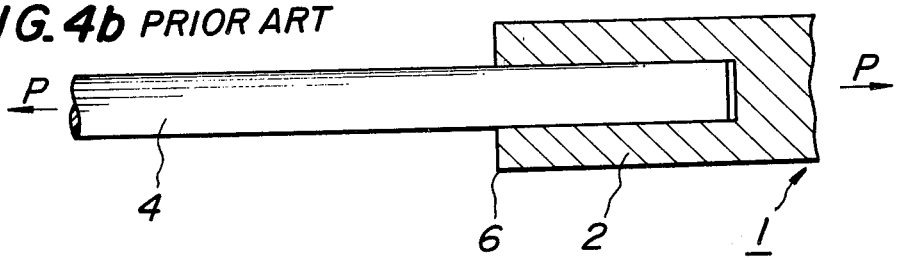
FIG. 4b PRIOR ART
FIG. 4*b* is an enlarged cross-sectional view of an essential part of the conventional holding structure, corresponding to the stress distribution curve shown in FIG. 4*a;*

In addition, during the practical use of an insulator, a load applied to a reinforced plastic rod 4 is low as shown by $\sigma_0$ in the characteristic curve b in FIG. 4*a*, but a high concentrated stress $\sigma_2$ occurs in the rod 4 at the vicinity of the reinforced plastic rod-receiving tip 6 of the sleeve 2. It can be seen from FIG. 4*a* that the value of $\sigma_2$ is considerably lower than the value of $\sigma_1$. However, the inventors have found out that, in practice, the reinforced plastic rod 4 is fatigued due to the vibration component subjected thereto, and hence the rod is broken just at the lower stress $\sigma_2$.

The insulator of the present invention is accomplished based on the discovery that, when a vibration component is contained in a load, a reinforced plastic rod is fatigued and broken even under a low practical stress level of $\frac{1}{2}$–$\frac{1}{4}$ of static breaking strength $\sigma_{FRP}$ of the rod.

The present invention provides an insulator comprising a fiber reinforced plastic rod and a holding metal fitting wholly or partly composed of a sleeve and holding said rod in the sleeve, an improvement comprising constituting said sleeve with a base portion for defining mainly the static load performance of the insulator and an inlet portion having a tapered thickness and defining mainly the vibration fatigue performance of the insulator.

The present invention will be explained in more detail referring to the drawings.

Figure 5A:
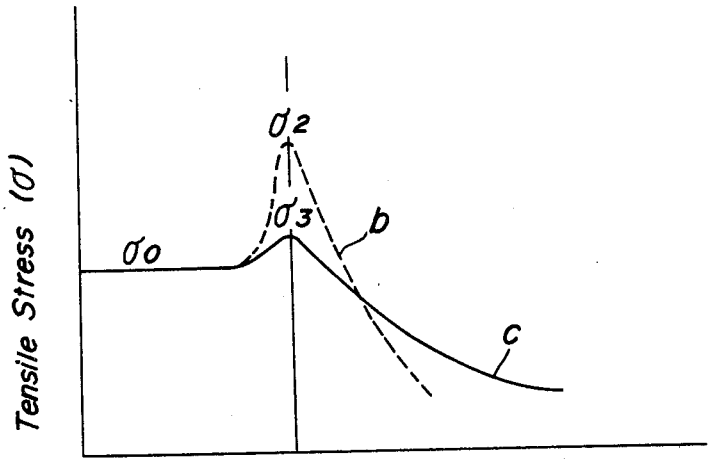
FIG. 5*a* is a stress distribution curve in a reinforced plastic rod held in a sleeve of an insulator of the present invention shown in the following FIG. 5*b;*
Figure 5B:
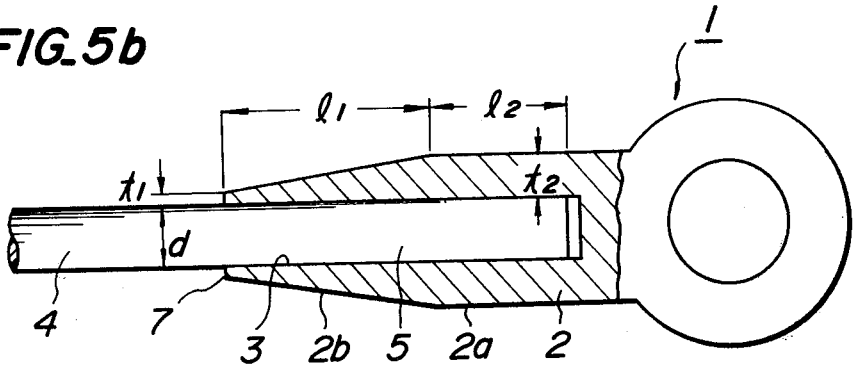
FIG. 5*b* is a front view of an insulator according to the present invention partly in section, showing that portion of a reinforced plastic rod which is held in a sleeve of a holding metal fitting.

The insulator of the present invention, as illustrated in FIG. 5*b*, comprises fundamentally a reinforced plastic rod 4, which has been produced by impregnating bundles of fibers, such as glass fibers or the like, arranged in their longitudinal direction or knitted fiber bundles with a synthetic resin, such as epoxy resin, polyester resin or the like, and bonding the impregnated fiber bundles through the resin, and a holding metal fitting 1 wholly or partly composed of a sleeve 2, that portion 5 of the reinforced plastic rod 4 which will be held being held in the bore 3 of the sleeve 2 under pressure, and said sleeve 2 comprising a base portion 2*a* and an inlet portion 2*b* having a tapered thickness. The base portion 2*a* has preferably a uniform thickness, and the inlet portion 2*b* is formed at the extended portion of the base portion and has preferably a thickness gradually decreasing towards a tip 7 for receiving a reinforced plastic rod.

In FIG. 5*b*, the shape of the reinforced plastic rod-receiving tip 7 of the sleeve 2 is formed into a flat surface perpendicular to the insulator axis. However, in order to alleviate the concentration of electric field, the tip 7 may be round in form, or a lip-shaped element (not shown in the figures) having a radius larger than the thickness of the tip may be attached to the tip end of the sleeve 2. When the lip-shaped element is attached to the tip end of the sleeve 2, the reinforced plastic rod-receiving tip of the sleeve 2 does not mean the tip end of the lip-shaped element, but means a portion, at which the curved inner side surface of the lip-shaped element contacts with the reinforced plastic rod, in this specification.

In general, the sleeve 2 which constitutes whole or a part of the holding metal fitting 1 is previously subjected to forging or cutting by a conventional method to form a base portion 2*a* and an inlet portion 2*b*, and a reinforced plastic rod 4 is inserted into the sleeve, and then the sleeve is compressed and deformed to secure the plastic rod to the sleeve. Alternatively, a reinforced plastic rod 4 is inserted into a sleeve 2 substantially having a uniform thickness, sleeve is compressed and deformed, and then the base portion 2*a* and inlet portion 2*b* may be formed by a conventional means, such as cutting or the like.

The thickness $t_1$ of the tip of inlet portion 2*b* is preferably not larger than 1/5 of the diameter d of the reinforced plastic rod 4. When the length $l_1$ of the inlet portion 2*b* is within the range of 1–20 times the diameter d of the reinforced plastic rod 4, the sleeve 2 has a smaller thickness and a lower rigidity in its tip portion, and is easily stretched corresponding to the stretching of the reinforced plastic rod 4. That is, the stress concentration in the reinforced plastic rod 4 at the vicinity of the reinforced plastic rod-receiving tip 7 of the sleeve 2 is low as shown by $\sigma_3$ in the characteristic curve c in FIG. 5*a*, and the stress concentration in the rod 4 is alleviated. A more preferable range of the length $l_1$ of the inlet portion 2*b* is 1.5–10 times the diameter d of the reinforced plastic rod 4. This fact has been ascertained from the following fact.

Figure 6:
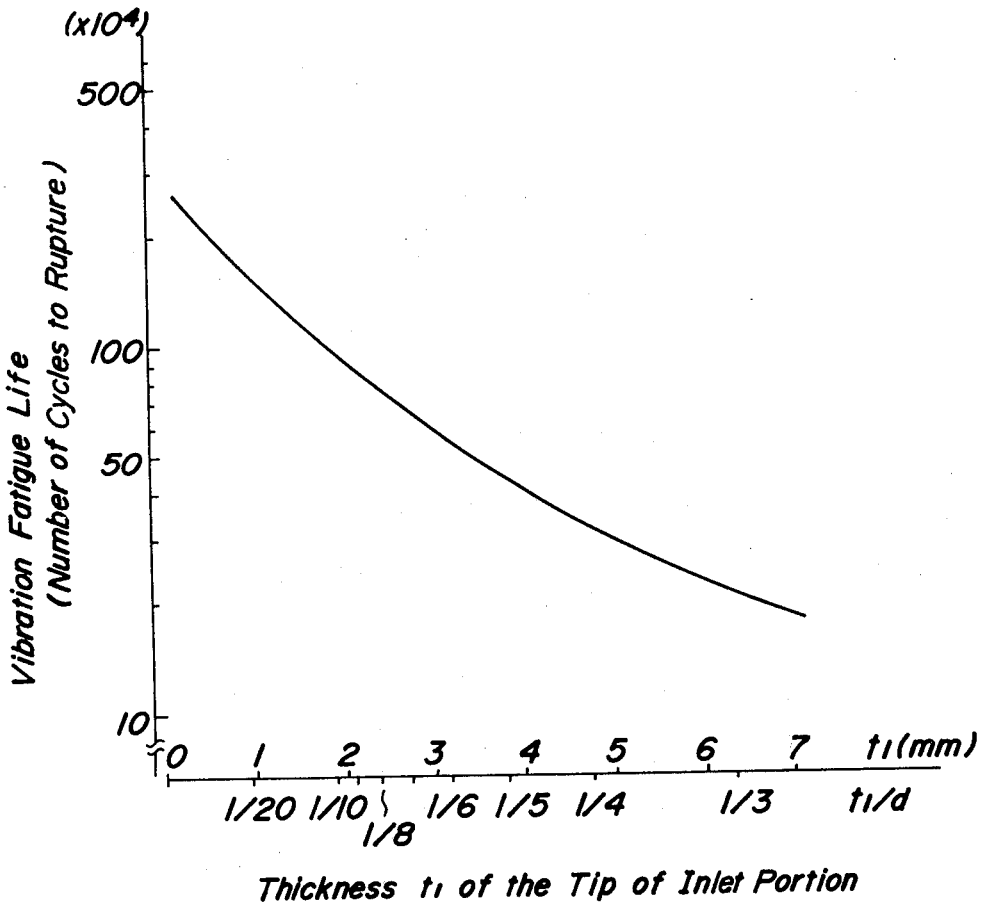
FIG. 6 is a graph illustrating a relation between the thickness of a sleeve at the tip of its inlet portion and the vibration fatigue life of a reinforced plastic rod held in the sleeve.

A vibration fatigue life test of a reinforced plastic rod 4 having a diameter d of 19 mm was carried out by varying the thickness $t_1$ of the tip of the inlet portion 2*b* of a sleeve 2 having a thickness $t_2$ of 7 mm and a length $l_2$ of 0 mm in its base portion 2*a* and having a length $l_1$ of 60 mm in its inlet portion 2*b*, FIG. 6 shows the result of the vibration fatigue test. In FIG. 6, the ordinate shows the vibration fatigue life of the rod 4 and the abscissa shows the thickness $t_1$ of the sleeve 2.

It can be seen from FIG. 6 that, as the thickness $t_1$ of the tip of the inlet portion 2*b* is smaller, the vibration fatigue life of the rod is longer. Accordingly, the thickness $t_1$ of the tip of the inlet portion is preferred to be not larger than d/5. The test condition of the above-described vibration fatigue life test is as follows. The reinforced plastic rod is cyclically stressed at a rate of 400 cycles/sec. under an average stress of 20 kg/mm$^2$ and a vibrational amplitude stress of 10 mg/mm$^2$.

Figure 7:
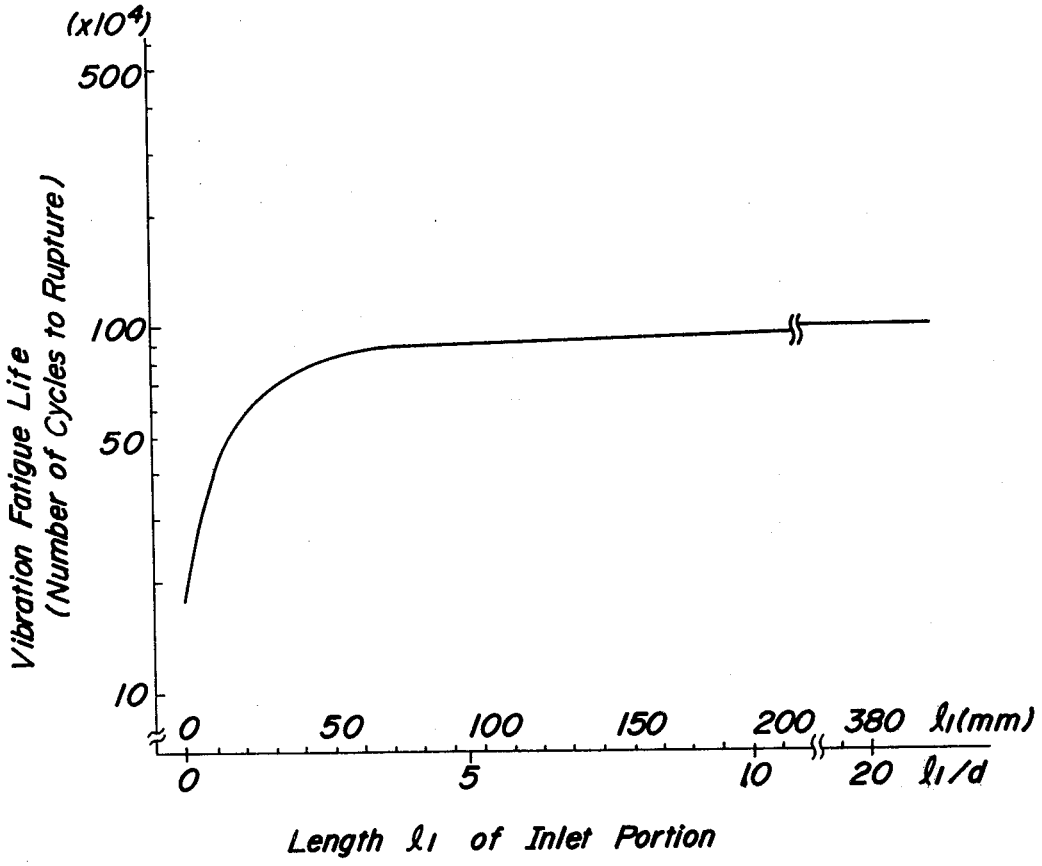
FIG. 7 is a graph illustrating a relation between the length of the inlet portion of a sleeve and the vibration fatigue life of a reinforced plastic rod held in the sleeve.

FIG. 7 shows the result of a vibration fatigue life test of a reinforced plastic rod 4 having a diameter d of 19 mm by varying the length $l_1$ of the inlet portion 2*b* of a sleeve having a thickness $t_1$ of 2 mm (about d/10) in the tip of its inlet portion 2*b*, and a thickness $t_2$ of 7 mm and a length $l_2$ of 165 mm in its base portion 2*a* under the same test condition as described above. In FIG. 7, the ordinate shows the vibration fatigue life and the abscissa shows the length $l_1$ of the inlet portion 2*b*. It can be seen from FIG. 7 that, the larger is the length $l_1$ of the inlet portion 2*b*, the longer the vibration fatigue life of the reinforced plastic rod is. When the length $l_1$ of an inlet portion 2*b* is more than 20 times the diameter d of a reinforced plastic rod 4, the strength of the holding structure is substantially saturated, and the fatigue life of the rod does not substantially increase. Accordingly, when a proper length $l_1$ of the inlet portion 2*b* is selected so as to be not more than 20 times the diameter d of a reinforced plastic rod 4, a holding metal fitting having a smaller weight can be produced.

Figure 8:
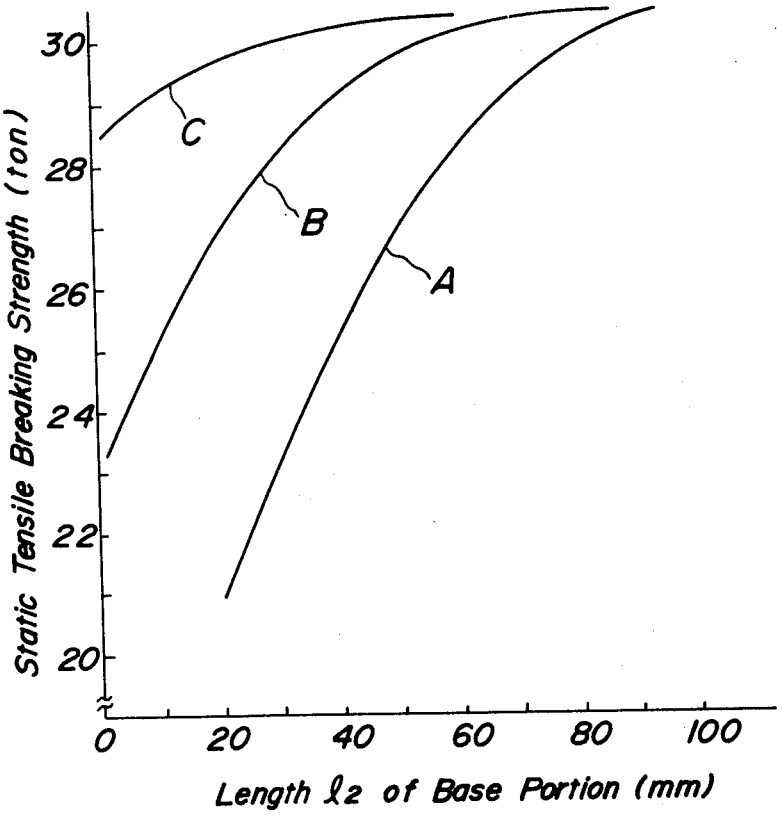
FIG. 8 is a graph illustrating a relation between the length of the base portion of a sleeve and the static tensile breaking strength of a reinforced plastic rod held in the sleeve.

The length $l_2$ of the base portion 2*a* is preferably determined in the following manner. A reinforced plastic rod having a diameter d of 19 mm was subjected to a static tensile breaking strength test (rate of loading: 500 kg/sec) by varying the length $l_2$ of the base portion 2*a* of each sleeve having a thickness $t_1$ of 2 mm (about d/10) in the tip of its inlet portion 2*b*, a thickness $t_2$ of 7 mm in its base portion 2*a* and a length $l_1$ of 20 mm, 60 mm or 100 mm in its inlet portion 2*b*. FIG. 8 shows the result. In FIG. 8, the ordinate shows the static tensile breaking strength of the rod and the abscissa shows the length $l_2$ of the base portion 2*a*. In FIG. 8, Curve A shows the strength of the rod when the length $l_1$ of the inlet portion 2*b* is 20 mm ($l_1$=d), Curve B shows the strength of the rod when the length $l_1$ is 60 mm ($l_1$=3*d*) and Curve C shows the strength of the rod when the length $l_1$ is 100 mm ($l_1$=5*d*).

According to Curve A, when $l_1$ is equal to d, the length $l_2$ of the base portion 2*a* is preferably at least 100 mm (5*d*). According to Curve B, when $l_1$ is equal to 3*d*, the length $l_2$ of the base portion 2*a* is preferably at least 60 mm (3*d*). Further, according Curve C, when $l_1$ is equal to 5*d*, the length $l_2$ of the base portion 2*a* is preferably at least 20 mm (1*d*). That is, the length $l_2$ varies depending upon the length $l_1$, and the inventors have empirically found out that the length $l_2$ is preferably larger than the value $l_2$ calculated by the formula:

$$l_2 = \left\{ \frac{15}{4} - \frac{3}{4}\left(\frac{l_1}{d}\right) \right\} \cdot d$$

in the insulator of the present invention.

The thickness $t_2$ of the base portion 2*a* can be determined such that the base portion 2*a* has a strength substantially equal to or larger than the tensile strength of a reinforced plastic rod by a calculation in the ordinary engineering. It is preferable that base portion 2*a* is made into uniform thickness over its entire length.

Figure 5C:
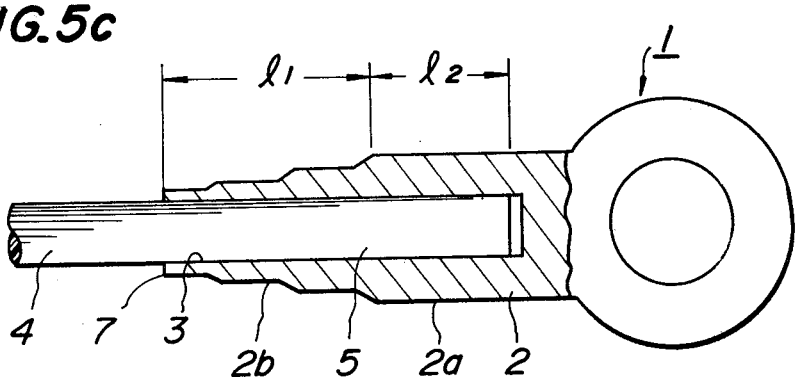
FIG. 5*c* is a front view of another insulator according to the present invention partly in section, showing that portion of a reinforced plastic rod which is held in a sleeve of a holding metal fitting.

The thickness distribution in its inlet portion 2*b* of the sleeve 2 shown in FIG. 5*b* decreases linearly. However, the thickness distribution is not limited to one shown in FIG. 5*b*, but may be decreased nonlinearly, for example stepwisely as shown in FIG. 5*c*. In any cases, it is preferable that the thickness of the inlet portion 2*b* decreases so as to form an inclined angle of 1.8°–30°, preferably 1.8°–20°, with respect to the insulator axis at the tip of the inlet portion 2*b* in order to prevent the sudden change of the rigidity of a sleeve at the vicinity of its reinforced plastic rod-receiving tip and to alleviate the stress concentration in the rod.

Further, it can be seen from the result of the static tensile breaking strength test shown in FIG. 8 that, when the length $l_1$ of the inlet portion is sufficiently long, the static tensile strength is saturated. That is, when the length $l_1$ of the inlet portion is sufficiently long, the end of the inlet portion for receiving reinforced plastic rod acts as an inlet portion, which defines mainly the vibration fatigue property of the insulator, and the other end of the inlet portion acts as a base portion, which defines mainly the static load performance of the insulator. Therefore, the base portion is not always necessary to have a uniform thickness and may be eventually formed by an extension of the tapered-thickness portion of an inlet portion in the present invention.

As described above, the insulator of the present invention has a holding portion having not only a base portion for defining mainly the static load performance of the insulator, but also an inlet portion for defining mainly the vibration fatigue performance of the insulator. Therefore, although the insulator of the present invention has substantially the same static load performance as that of a conventional insulator which has been designed by taking only the static tensile load into consideration, the insulator of the present invention has a fatigue life as long as more than 4 times the fatigue life of the conventional insulator. This fact has been ascertained from the experimental data shown in FIGS. 6 and 7. That is, an inlet portion having a thickness $t_1$ of 7 mm in its tip in FIG. 6, or an inlet portion having a length $l_1$ of 0 mm in FIG. 7 corresponds to conventional holding structure. Therefore, the insulator of the present invention is superior to conventional insulators in the vibration fatigue performance.

Therefore, according to the present invention, insulators having an excellent fatigue performance, which has never been attained by a conventional holding structure, can be obtained without deteriorating their static load performance. Moreover, the insulators having such high strength in the holding structure of the reinforced plastic rod by the holding metal fitting can be widely used as an insulator for an electric line for a tram car, for a power transmission line and the like, as such or after covered with a proper overcoat, shield electrode or the like. Therefore, the present invention is very useful for industry.

What is claimed is:

1. In an insulator comprising a fiber reinforced plastic rod having a substantially cylindrical outer surface and a holding metal fitting, said holding metal fitting including a sleeve having a cylindrical inner surface, said sleeve receiving an end of said rod and frictionally holding said rod by being compressed onto the rod, an improvement comprising said sleeve including a base portion having a large thickness and defining mainly the static load performance of the insulator and an inlet portion having a tapered thickness and defining mainly the vibration fatigue performance of the insulator, said inlet portion being formed at an extended portion of the base portion so as to form a unitary body having a seamless cylindrical bore together with the base portion and having a thickness gradually decreasing towards a tip for receiving the FRP rod and further satisfying the conditions that the relation between the thickness $t_1$ of the inlet portion and the diameter d of the rod is $t_1 \leqq d/5$, and the relation between the length $l_1$ of the inlet portion and the diameter d of the rod is $d \geqq l_1 \geqq 20d$; and the rod being frictionally held by the base portion and the inlet portion.

2. An insulator according to claim 1, wherein said base portion has a uniform thickness.

3. An insulator according to claim 1, wherein said relation is $$1.5d \leqq l_1 \leqq 10d.$$

4. An insulator according to claim 1, wherein the tapered surface of the inlet portion inclines at an angle of 1.8°–30° with respect to the insulator axis.

* * * * *